US010114331B2

(12) United States Patent
Fujita et al.

(10) Patent No.: US 10,114,331 B2
(45) Date of Patent: Oct. 30, 2018

(54) TRANSFER DEVICE AND IMAGE FORMING APPARATUS INCORPORATING SAME

(71) Applicants: Junpei Fujita, Kanagawa (JP); Katsuhito Haruno, Kanagawa (JP); Atsushi Nakamoto, Kanagawa (JP); Masakazu Imai, Kanagawa (JP); Osamu Ichihashi, Kanagawa (JP); Takehide Mizutani, Tokyo (JP); Naoto Kochi, Tokyo (JP)

(72) Inventors: Junpei Fujita, Kanagawa (JP); Katsuhito Haruno, Kanagawa (JP); Atsushi Nakamoto, Kanagawa (JP); Masakazu Imai, Kanagawa (JP); Osamu Ichihashi, Kanagawa (JP); Takehide Mizutani, Tokyo (JP); Naoto Kochi, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/831,566

(22) Filed: Dec. 5, 2017

(65) Prior Publication Data

US 2018/0157209 A1 Jun. 7, 2018

(30) Foreign Application Priority Data

Dec. 6, 2016 (JP) ..... 2016-236581

(51) Int. Cl.
*G03G 15/20* (2006.01)
*G03G 21/00* (2006.01)
(Continued)

(52) U.S. Cl.
CPC ..... *G03G 21/0094* (2013.01); *G03G 15/161* (2013.01); *G03G 15/1675* (2013.01);
(Continued)

(58) Field of Classification Search
CPC ..... G03G 21/0094; G03G 15/161; G03G 15/1675; G03G 15/5008; G03G 21/0011; G03G 2215/00059
(Continued)

(56) References Cited

U.S. PATENT DOCUMENTS

2008/0124155 A1 5/2008 Mimbu
2011/0058859 A1 3/2011 Nakamatsu et al.
(Continued)

FOREIGN PATENT DOCUMENTS

EP 2367073 A2 9/2011
JP H11-133762 A 5/1999
(Continued)

OTHER PUBLICATIONS

Extended European Search Report dated Apr. 10, 2018.

*Primary Examiner* — Susan Lee
(74) *Attorney, Agent, or Firm* — Harness, Dickey & Pierce, P.L.C.

(57) ABSTRACT

A transfer device includes an image bearer, a rotatable body, a solid lubricant assembly, and a guide. An image bearer bears an image. The rotatable body forms a transfer nip with the image bearer to rotate in contact with a recording medium. An image on the image bearer is transferred onto the recording medium at the transfer nip. The solid lubricant assembly includes a solid lubricant and extends in a longitudinal direction of the rotatable body. The solid lubricant assembly applies a solid lubricant to at least one of the rotatable body and the image bearer. The guide guides the recording medium and positions the solid lubricant assembly.

14 Claims, 9 Drawing Sheets

(51) Int. Cl.
*G03G 15/16* (2006.01)
*G03G 15/00* (2006.01)

(52) U.S. Cl.
CPC ..... *G03G 15/5008* (2013.01); *G03G 21/0011* (2013.01); *G03G 2215/00059* (2013.01)

(58) Field of Classification Search
USPC ..... 399/313
See application file for complete search history.

(56) References Cited

U.S. PATENT DOCUMENTS

| | | | | |
|---|---|---|---|---|
| 2011/0064487 | A1 | 3/2011 | Ichihashi et al. | |
| 2011/0293312 | A1* | 12/2011 | Mimbu ..... | G03G 15/1645 399/88 |
| 2012/0121293 | A1 | 5/2012 | Mimbu et al. | |
| 2014/0334847 | A1 | 11/2014 | Takahashi et al. | |
| 2015/0055981 | A1 | 2/2015 | Fujita et al. | |
| 2016/0091816 | A1 | 3/2016 | Kochi | |
| 2016/0161888 | A1 | 6/2016 | Wada et al. | |
| 2016/0170364 | A1 | 6/2016 | Kogure et al. | |
| 2016/0274504 | A1 | 9/2016 | Wada et al. | |
| 2017/0010566 | A1 | 1/2017 | Kato et al. | |
| 2017/0090374 | A1 | 3/2017 | Fujita et al. | |
| 2017/0168429 | A1 | 6/2017 | Imai et al. | |
| 2017/0168430 | A1 | 6/2017 | Imai et al. | |
| 2017/0235257 | A1 | 8/2017 | Kochi et al. | |
| 2017/0235258 | A1 | 8/2017 | Wada et al. | |

FOREIGN PATENT DOCUMENTS

| | | |
|---|---|---|
| JP | 2002-351258 A | 12/2002 |
| JP | 2006-003537 | 1/2006 |
| JP | 2009-042295 | 2/2009 |

* cited by examiner

TRANSFER DEVICE AND IMAGE FORMING APPARATUS INCORPORATING SAME

CROSS-REFERENCE TO RELATED APPLICATION

This patent application is based on and claims priority pursuant to 35 U.S.C. § 119 to Japanese Patent Application No. 2016-236581, filed on Dec. 6, 2016, in the Japanese Patent Office, the entire disclosure of which is hereby incorporated by reference herein.

BACKGROUND

Technical Field

Aspects of the present disclosure relate to a transfer device and an image forming apparatus incorporating the transfer device.

Background Art

Conventional image forming apparatuses use a lubricant applying member such as a brush roller or a sponge roller, and apply a lubricant including zinc stearate or the like to a photoconductor drum or an intermediate transfer belt. Application of the lubricant prolongs the life of the photoconductor drum and the intermediate transfer belt, helps prevent hollow images in a transfer process, and increases transfer performance.

SUMMARY

This specification describes an improved transfer device and an image forming apparatus incorporating the transfer device, which, in one illustrative embodiment, includes an image bearer, a rotatable body, a solid lubricant assembly, and a guide. An image bearer bears an image. The rotatable body forms a transfer nip with the image bearer to rotate in contact with a recording medium. At the transfer nip, the image on the image bearer is transferred onto the recording medium. The solid lubricant assembly includes a solid lubricant and extends in a longitudinal direction of the rotatable body. The solid lubricant assembly applies a solid lubricant to at least one of the rotatable body and the image bearer. The guide guides the recording medium and positions the solid lubricant assembly.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

DETAILED DESCRIPTION

Figure 1:
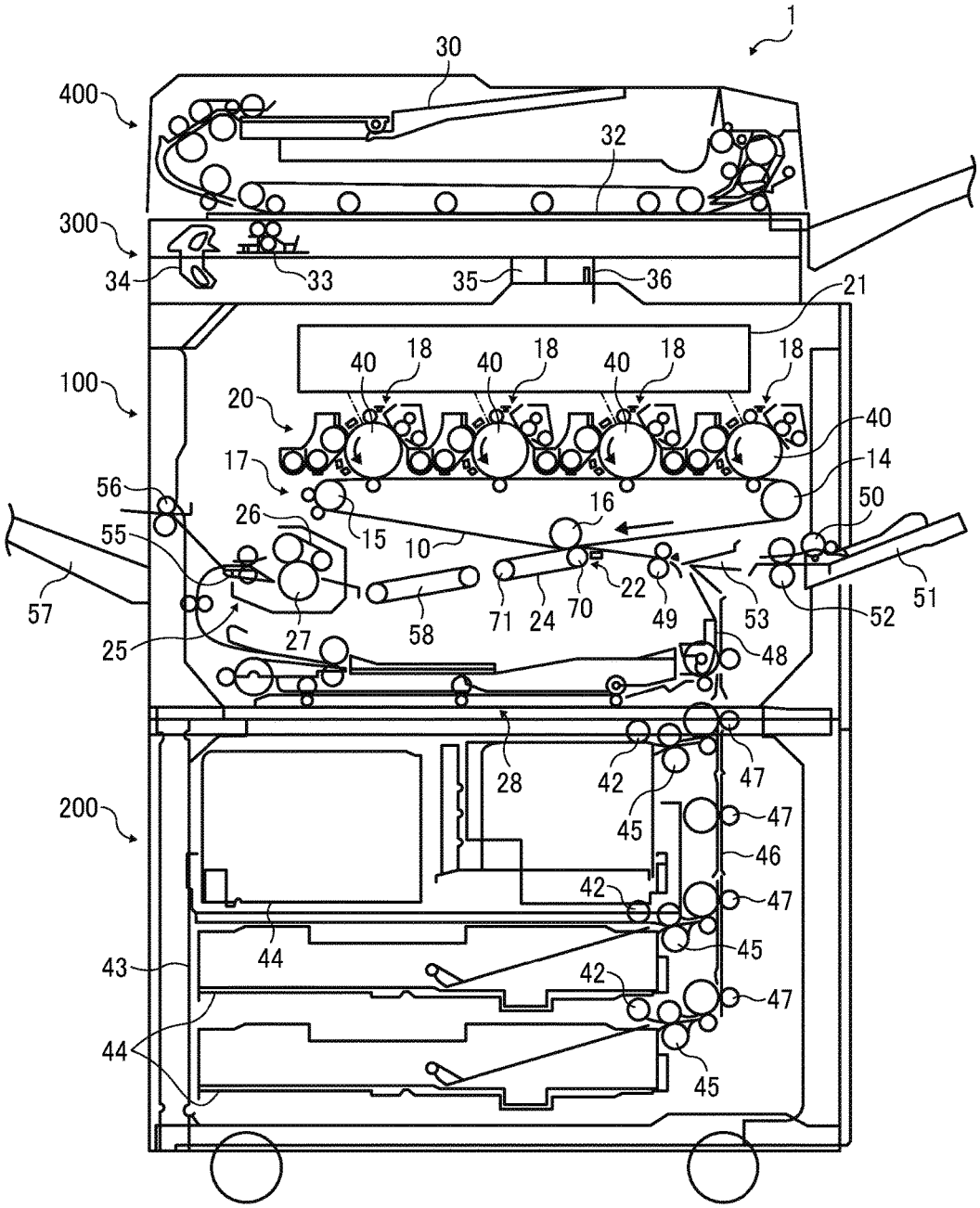
FIG. 1 is a schematic diagram illustrating a color copier employing a tandem type indirect transfer system according to an embodiment of the present disclosure.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

The configurations related to the present disclosure are described based on embodiments illustrated in the accompanied drawings from FIGS. 1 to 9.

Referring now to the drawings, wherein like reference numerals designate identical or corresponding parts throughout the several views thereof, and particularly to FIG. 1, a color copier 1 of an image forming apparatus employing electrophotography, according to an embodiment of the present disclosure is described.

Before describing the embodiment, preliminary items for facilitating an understanding of the embodiment will be described below.

In recent years, there has been increasing demand for miniaturizing an image forming apparatus and reducing maintenance work. One approach studied in developing an image forming apparatus, particularly a transfer device, is a configuration that can be attached without increasing the number of parts and that applies a lubricant to a secondary transfer belt for a long time.

The transfer device includes a cleaning blade for scraping off toner remaining on the transfer belt at an upstream side in a direction of rotation of the transfer belt and a conveyance guide for smoothly conveying a recording medium to a transfer nip on a downstream side in the direction of rotation of the transfer belt. The transfer device includes the lubricant and a brush for applying the lubricant to the transfer belt between the cleaning blade and the conveyance guide to apply the lubricant to a surface of the transfer belt before the transfer belt cleaned by the cleaning blade contacts the recording medium.

However, in order to make the image forming apparatus smaller, it is desirable to narrow the space between the cleaning blade and the conveyance guide. A configuration in which the lubricant case accommodating the lubricant and the guide member supports the lubricant makes the lubricant smaller by an amount equivalent to the volume of the case. Therefore, the configuration makes it difficult to increase the period of applying the lubricant. In addition, because use of the lubricant case increases the number of parts, it is not preferable from the viewpoint of manufacturing and reliability.

In the following embodiment, the transfer device is described in which the solid lubricant is positioned without increasing the number of parts and decreasing a volume of the solid lubricant.

Embodiment

FIG. 1 is a schematic diagram illustrating a color copier 1 employing a tandem type indirect transfer system according to the present embodiment of the present disclosure. The color copier 1 employs an intermediate transfer system, but the present disclosure is not limited to the intermediate transfer system. It is possible to apply the present disclosure to an image forming apparatus of a direct transfer system.

In FIG. 1, a main body 100 of the copier is on a sheet feeding table 200, a scanner 300 is on the main body 100 of the copier, and an automatic document feeder (ADF) 400 is further on the scanner 300.

The main body 100 of the copier includes an intermediate transfer belt 10 that is an endless belt, at the center of the main body 100 of the copier. The intermediate transfer belt as an image bearer is wound around three support rollers 14, 15, and 16 in FIG. 1 and is rotatable in a clockwise direction in FIG. 1.

In FIG. 1, a tandem image forming section 20 includes a belt cleaner 17 on the left side of the second support roller 15 for removing residual toner remaining on the intermediate transfer belt 10 after image transfer. In addition, the tandem image forming section 20 includes four image forming units 18 corresponding to yellow, magenta, cyan, and black arranged along a direction of rotation of the intermediate transfer belt 10 on the intermediate transfer belt 10 stretched between the first support roller 14 and the second support roller 15.

The image forming unit 18 is detachably provided as a process cartridge in the main body 100. Above the tandem image forming section 20, there is an exposure device 21. On the other hand, on the opposite side of the intermediate transfer belt 10 from the tandem image forming section 20, there is a secondary transfer unit 22. In FIG. 1, the secondary transfer unit 22 includes a secondary transfer belt 24, which is an endless belt, bridged between two rollers 70 and 71. The secondary transfer belt 24 is disposed to press against the third support roller 16 via the intermediate transfer belt 10, and transfers an image on the intermediate transfer belt 10 onto a sheet 2 as a recording medium. Therefore, the secondary transfer unit 22 as the transfer device of the present disclosure includes the intermediate transfer belt 10.

A fixing device 25 for fixing the image transferred on the sheet 2 is disposed beside the secondary transfer unit 22. The fixing device 25 includes a fixing belt 26 that is an endless belt and a pressure roller 27 pressed against the fixing belt 26. The above-described secondary transfer unit 22 also has a sheet conveying function for conveying the sheet 2 to which the image is transferred to the fixing device 25. Of course, the secondary transfer unit 22 may be a charger that does not contact the sheet 2 or the intermediate transfer belt. When a secondary transfer charger is used, another member conveys the sheet 2.

In FIG. 1, a sheet-inverting device 28 that inverts the sheet 2 to record the images on both sides of the sheet 2 is disposed under the secondary transfer unit 22 and the fixing device in parallel to the above-described tandem image forming section 20.

When a user makes a copy using this color copier 1, the user places a document on a document table 30 of the ADF 400. Alternatively, the user may place the document on an exposure glass 32 of the scanner 300 after lifting the ADF 400 and may press the document against the exposure glass 32 by lowering the ADF 400. When the user presses the start switch of the color copier 1, the ADF 400 conveys the set document onto the contact glass 32. When the document is set on the contact glass 32, the scanner 300 immediately is driven. That is, a first carriage 33 and a second carriage 34 move. The light source in the first carriage 33 emits light, and the mirror in the first carriage 33 further reflects the light reflected from the document surface and leads the light to the second carriage 34. The mirror in the second carriage 34 reflects the light and leads the light to an imaging lens 35. The light passing through the imaging lens 35 enters a reading sensor 36. Based on the light reflected from the document, the reading sensor 36 reads a content of the document.

When the user presses the start switch of the color copier 1, the driving motor rotates any one of the support rollers 14, 15, and 16. A rotated roller rotates the intermediate transfer belt 10. The other two support rollers are driven by a rotation of the intermediate transfer belt 10. At the same time, the driving motor rotates the photoconductor 40 (a rotatable image bearer) in each of the image forming units 18. A single-color image of one of yellow, magenta, cyan, and black is formed on each photoconductor 40. When the intermediate transfer belt 10 rotates, the single-color images are sequentially transferred, and a composite color image is formed on the intermediate transfer belt 10. The intermediate transfer belt 10 as an image bearer bears the composite color image on its surface.

On the other hand, when the user pushes the start switch, a feed roller 42 of the selected sheet tray 44 in the sheet feeding table 200 rotates, and the sheet 2 is fed from one of the sheet trays 44 disposed on multi stage of a paper bank 43 in the sheet feeding table 200. A separation roller 45 separates the fed sheets 2 one by one and puts the sheet 2 in a conveyance passage 46. A conveyance roller 47 conveys the sheet 2, and leads the sheet 2 to a conveyance passage 48 in the main body 100 of the copier. The sheet 2 contacts a registration roller 49 and stops. When the user uses a bypass tray, a feed roller 50 rotates to feed the sheet 2 on the bypass tray 51. A separation roller 52 separates the fed sheets 2 one by one and puts the sheet 2 in a bypass conveyance passage 53. Similar to the sheet 2 led from the conveyance passage 48, the sheet 2 that enters the bypass conveyance passage 53 contacts the registration roller 49 and stops.

When the composite color image on the intermediate transfer belt 10 comes to the secondary transfer region between the intermediate transfer belt 10 and the secondary transfer unit 22, the registration roller 49 rotates to feed the sheet 2 so that the sheet 2 meets the composite color image at the secondary transfer region. The secondary transfer unit 22 transfers the color image from the intermediate transfer belt 10 onto the sheet 2. The secondary transfer unit 22 includes a secondary transfer belt 24 supported by a secondary transfer roller 70 and a driven roller 71. The sheet 2 on which the image is transferred is separated from the surface of the secondary transfer belt 24 by the curvature of the driven roller 71 at the position of the driven roller 71 and is conveyed to a conveyance belt 58. The conveyance belt 58 feeds the sheet 2 toward the fixing device 25. The fixing device 25 applies heat and pressure to the sheet 2 fed from the conveyance belt 58, and fixes the transferred image on the sheet 2. A switching claw 55 is disposed downstream of the fixing device 25 in a sheet direction of conveyance. The switching claw 55 switches the sheet direction of conveyance and guides the sheet 2 to the discharge roller 56 or the sheet-inverting device 28. The sheet 2 guided to the discharge roller 56 is discharged to the outside of the image forming apparatus and stacked on an output tray 57. The sheet 2 guided to the sheet-inverting device 28 is inverted by the sheet-inverting device 28 and conveyed again to the secondary transfer region. An image is also recorded on the back surface of the inverted sheet 2. After that, the sheet 2 is guided to the discharge roller 56, and discharged onto the output tray 57.

After the image is transferred from the intermediate transfer belt 10 onto the sheet 2, the belt cleaner 17 removes residual toner remaining on the intermediate transfer belt 10 after image transfer. Thus, the tandem image forming section 20 enables the next image formation.

The intermediate transfer belt 10 is constructed of a single layer or a plurality of layers including polyvinylidene fluoride (PVDF), ethylene tetrafluoroethylene (ETFE) copolymer, polyimide (PI), polycarbonate (PC), and the like. The layers is/are adjusted such that a conductive material such as carbon black is dispersed and its volume resistivity is $10^8$ to $10^{12}$ Ω·cm and its surface resistivity is $10^9$ to $10^{13}$ Ω·cm. If necessary, the intermediate transfer belt 10 may have a release layer coated on its surface. Materials used for the coating include ethylene-tetrafluoroethylene copolymer (ETFE), polytetrafluoroethylene (PTFE), vinylidene fluoride (PVDF), perfluoroalkoxy fluorine resin (PEA), Ethylene-hexafluoropropylene copolymer (FEP), vinyl fluoride (PVF), etc., but is not limited thereto.

The intermediate transfer belt 10 is manufactured through a casting process, a centrifugal casting process, and the like. If necessary, the surface of the intermediate transfer belt 10 may be polished.

In the measurement of the volume resistivity and the surface resistivity, a high-resistivity meter (Hiresta IP made by Mitsubishi Chemical Corporation) connected with an HRS probe (inner electrode diameter 5.9 mm, ring electrode inner diameter 11 mm) is used. The volume resistivity is measured as a value measured after 10 seconds after a voltage of 100 V is applied between the front and back of the intermediate transfer belt 10. When the surface resistivity is measured, the voltage applied to the intermediate transfer belt is set 500 V.

The transfer roller is made by applying a foaming resin agent to a cored bar made of metal (iron, stainless steel, aluminum, etc.). The thickness of the foamed resin agent is 2 mm to 10 mm, but it is not limited thereto.

Figure 2A:
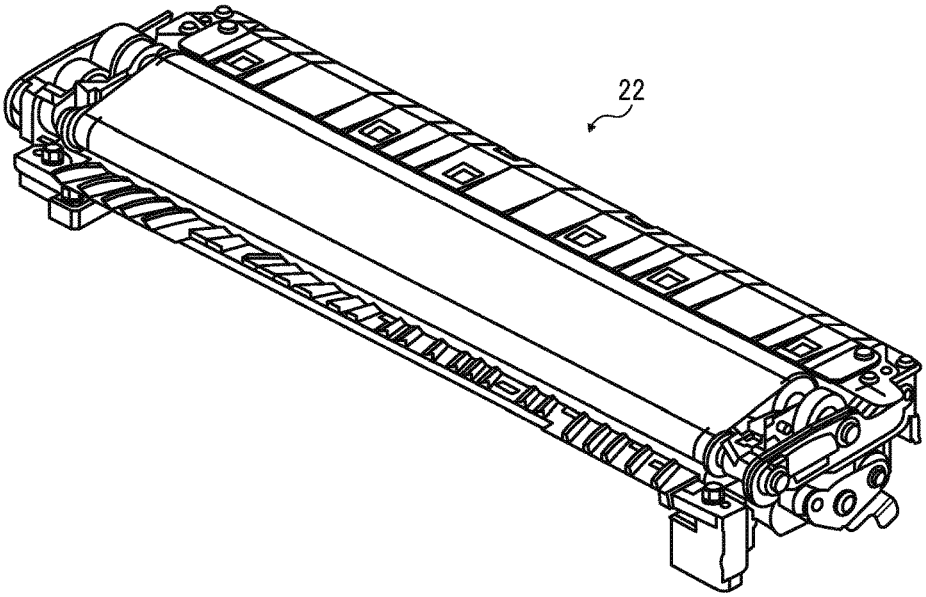
FIG. 2A is a top perspective view of a secondary transfer unit according to the embodiment of the present disclosure.
Figure 2B:
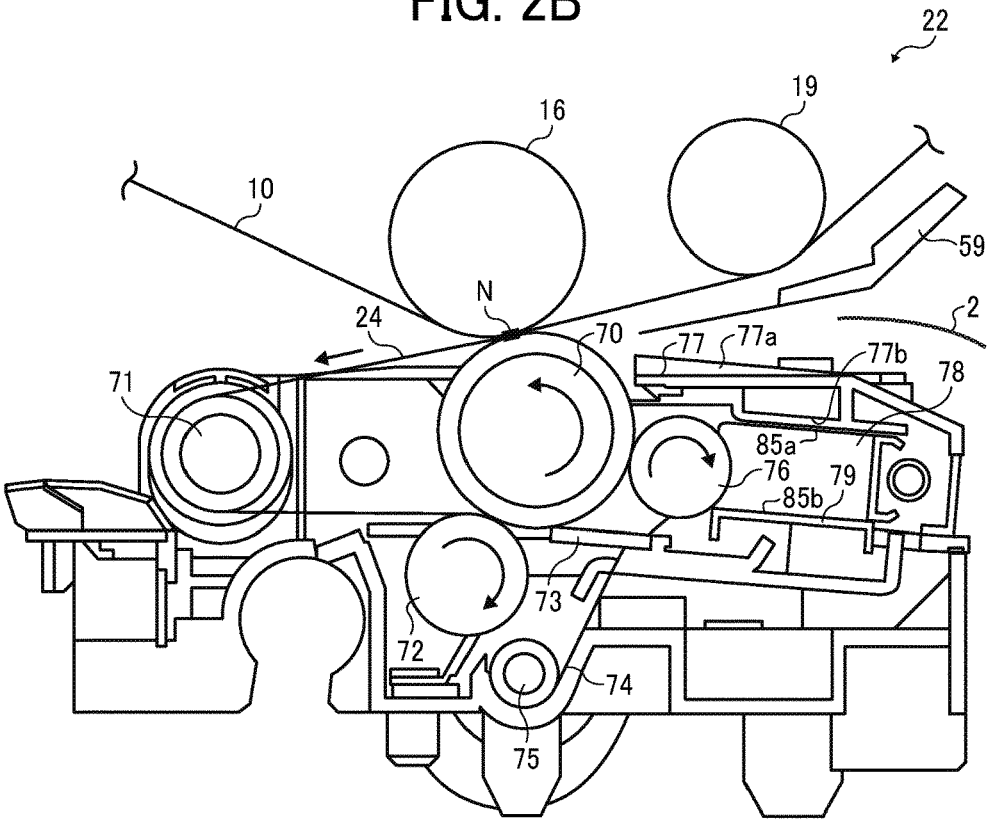
FIG. 2B is a cross-sectional view illustrating a configuration example of the secondary transfer unit illustrated in FIG. 2A.

Subsequently, a configuration of the secondary transfer unit 22, which is a characteristic part of the present disclosure, is described. FIG. 2A is a top perspective view of a secondary transfer unit according to the embodiment of the present disclosure. FIG. 2B is a cross-sectional view illustrating a configuration example of the secondary transfer unit.

As illustrated in FIG. 2B, the secondary transfer belt 24 is wound around the secondary transfer roller 70 and the driven roller 71, and is rotated counterclockwise in FIG. 2B. The secondary transfer unit 22 includes a brush 72 for removing paper dust, a cleaning blade 73, a lubricant application brush 76 that is a lubricant applicator, and a conveyance guide 77 in the secondary transfer unit, all of which are arranged in that order upstream to downstream in the direction of rotation of the secondary transfer roller 70.

As illustrated in FIG. 2B, an intermediate transfer belt 10 is disposed above the secondary transfer unit 22. The intermediate transfer belt 10 is wound around a third support roller (a secondary transfer opposite roller) 16 and a push down roller 19, respectively. The secondary transfer roller 70 is pushed toward the third support roller (the secondary transfer opposite roller) 16 by a spring or the like. A transfer nip N to transfer a toner image borne on the intermediate transfer belt 10 onto the sheet 2 is formed between the secondary transfer belt 24 supported by the secondary transfer roller 70 and the intermediate transfer belt 10 supported by the third support roller (the secondary transfer opposite roller) 16.

The push down roller 19 pushes the intermediate transfer belt 10 downward as illustrated in FIG. 2B at a position upstream of the transfer nip N in the direction of rotation of the intermediate transfer belt 10. A guide plate (an intermediate transfer side conveyance guide) 59 on the intermediate transfer guide side and the conveyance guide 77 are provided at a position on an upstream side of the transfer nip N in a sheet direction of conveyance. The conveyance guide 77 contacts the back surface of the sheet 2, and the guide plate 59 on the intermediate transfer guide side contacts the front surface of the sheet 2. Each of the conveyance guide 77 and the guide plate 59 guides the sheet 2 toward the transfer nip N. In the present embodiment, the guide plate 59 on the intermediate transfer guide side and the conveyance guide 77 guide the sheet 2 so that the leading edge of the sheet 2 contacts a surface of the secondary transfer belt 24 at a position on the upstream side from the transfer nip N in the sheet direction of conveyance (in FIG. 2B).

How to guide the sheet 2 is not limited to this. For example, the guide plate 59 on the intermediate transfer guide side and the conveyance guide 77 may guide the sheet 2 so that the leading edge of the sheet 2 contacts a surface of the intermediate transfer belt 10 at a position on the upstream side from the transfer nip N in the sheet direction of conveyance (in FIG. 2B).

Alternatively, either one of the guide plate 59 on the intermediate transfer guide side and the conveyance guide 77 may guide the leading edge of the sheet 2, and the other of the guide plate 59 on the intermediate transfer guide side and the conveyance guide 77 or both may guide a portion other than the leading edge of the sheet 2.

A conveyance posture (conveyance position) of the sheet 2 in the image forming apparatus differs depending on stiffness and thickness of the sheet 2. The conveyance guide 77 may be arranged so that only the thin sheet 2 or the curled sheet 2 is guided by the conveyance guide 77.

The brush 72 for removing the paper dust is rotatable in a clockwise direction in FIG. 2B, and removes dust adhering to the surface of the secondary transfer belt 24. The cleaning blade 73 contacts the surface of the secondary transfer belt 24 to scrape off the toner adhering to the secondary transfer belt 24. The removed waste toner falls into a waste toner bottle 74 disposed under the cleaning blade 73, and a conveying screw 75 conveys the removed waste toner.

The lubricant application brush 76, disposed on the downstream side in the direction of rotation of the secondary transfer roller 70 from the cleaning blade 73 is between the solid lubricant assembly 78 and the secondary transfer belt 24 (the secondary transfer roller 70), rotates and rubs both of them. That is, the lubricant application brush 76 applies the solid lubricant assembly 78 to the secondary transfer belt 24. The lubricant reduces the friction coefficient of the surface of the secondary transfer belt 24 and prevents the cleaning blade 73 from turning. Alternatively, instead of the lubricant application brush 76, a sponge roller may be used. These lubricant applicators enable to apply the lubricant uniformly to the secondary transfer belt.

The solid lubricant assembly 78 extends in the longitudinal direction of the secondary transfer belt 24 and has a constant height in the height direction orthogonal to the longitudinal direction thereof. The conveyance guide 77 is used for smoothly guiding the recording medium to the transfer nip (for example, in FIG. 1, the third support roller 16 and the secondary transfer belt 24 form the transfer nip N).

In order to apply the lubricant after the dust and the residual toner are removed from the secondary transfer belt 24, the parts from the brush 72 for removing the paper dust to the conveyance guide 77 are disposed in the described order around the secondary transfer belt 24. Since the lubricant is applied after the surface of the secondary transfer belt 24 is cleaned, the lubricant is uniformly applied to the surface of the secondary transfer belt 24. Therefore, the friction coefficient of the surface of the secondary transfer belt 24 decreases uniformly, which reliably prevents the turning of the cleaning blade 73. This extends a life of the secondary transfer belt 24 and the secondary transfer unit.

As described above, it is desirable that the space between the cleaning blade 73 and the conveyance guide 77 be narrowed in the image forming apparatus in which miniaturization is desired. The structure that supports the lubricant with the lubricant case requires improvement because the structure reduces the capacity of the lubricant and increases the number of components such as the lubricant case. In the present embodiment, the lubricant is not supported by the lubricant case. The present embodiment employs a configuration in which the solid lubricant assembly 78 is supported and positioned by using existing components, in particular, the conveyance guide 77. The configuration is described in detail below.

Figure 3A:
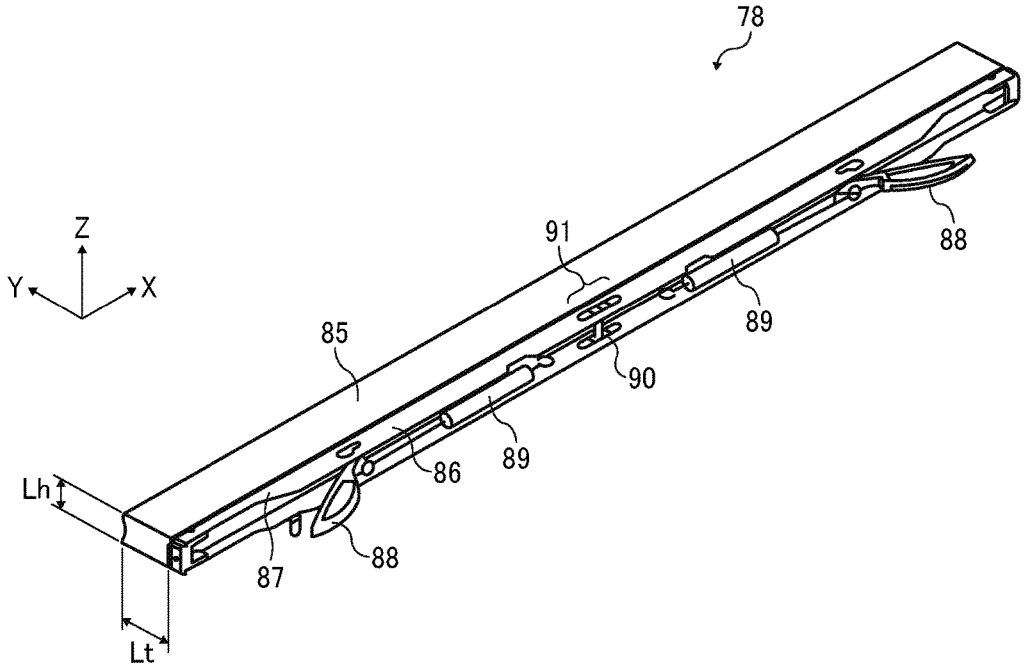
FIG. 3A is a top perspective view of a solid lubricant assembly.

FIG. 3A is a perspective view of a solid lubricant. As illustrated in FIG. 3A, to apply the lubricant to a conveyance area of the recording medium on the secondary transfer belt 24, the solid lubricant assembly 78 extends in a longitudinal direction (X-direction) of the secondary transfer belt 24 and has a thickness Lh in a thickness direction (Z-direction) orthogonal to the longitudinal direction. The solid lubricant assembly 78 also has a height Lt in a height direction (Y-direction) orthogonal to the longitudinal direction and the thickness direction to be able to apply the lubricant for a long time. Increasing the thickness Lh and the height Lt makes it possible to increase the volume of the lubricant and apply the lubricant for a long time.

The solid lubricant assembly 78 includes a lubricant portion 85 that is the lubricant and a biasing portion 86 that presses the lubricant portion 85 toward the secondary transfer belt 24. The biasing portion 86 includes a frame 87 made of sheet metal, two pressure arms 88, and two pressure springs 89. Each of the pressure arms 88 is rotatably supported on the frame 87 and attached with one end of the pressure spring 89. Each of the pressure springs 89 is extended, and another end of each of the pressure springs 89 is attached to a pin 90 that is inserted in the frame 87. (In FIG. 3A, the pressure springs 89 are not attached to the pin 90.) Therefore, each of the two pressure arms 88 receives a tensile force from each of the pressure springs 89 and is pressed in a direction to pop out from the frame 87, as illustrated in FIG. 3A.

There are multiple insert holes 91 for the pin 90 in the frame 87. Changing a position of the pin 90 enables adjusting the tensile force of the pressure springs 89 that act the pressure arms 88.

Figure 3B:
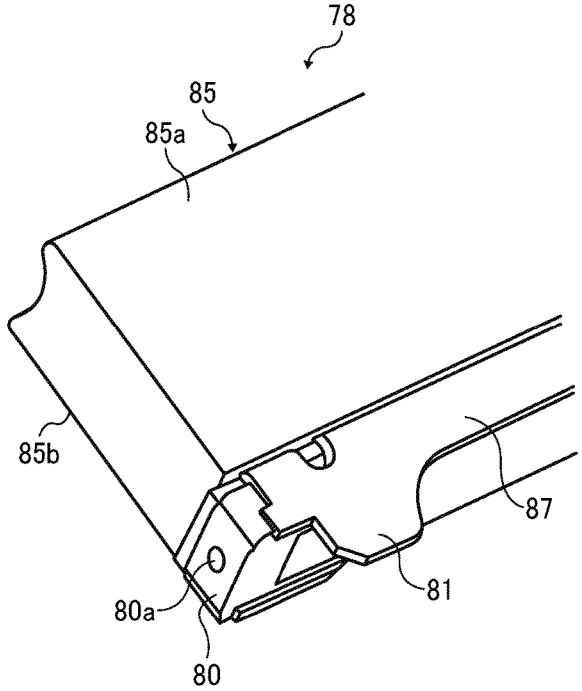
FIG. 3B is a partially enlarged view of FIG. 3A.

FIG. 3B is a partially enlarged view of the solid lubricant assembly 78 illustrated in FIG. 3A. For convenience of explanation, only one end of the solid lubricant assembly 78 is illustrated in FIG. 3B. Another end of the solid lubricant assembly 78 has the same structure. As illustrated in FIG. 3B, the solid lubricant assembly 78 includes end portions 80 positioned at both ends in a longitudinal direction of the solid lubricant assembly 78 and a receiving face 81 that is a part of the frame 87, an upper face 85*a*, and a bottom face 85*b*. The end portion 80 is made of a resin having an excellent sliding characteristic and includes a boss 80*a*.

Referring back to FIG. 2B, a description is provided of the configuration of the solid lubricant assembly 78. As illustrated in FIG. 2B, the solid lubricant assembly 78 is supported at its bottom face 85*b* by a retainer 79 and positioned at its upper face 85*a* by the conveyance guide 77. The retainer 79 is made of a sheet metal, for example, and is above the cleaning blade 73. The cleaning blade 73 contacts the secondary transfer belt 24 and reciprocates on the secondary transfer belt 24 while the cleaning blade 73 slides over the secondary transfer belt 24. Therefore, the retainer 79 and the cleaning blade 73 are different parts.

Figure 4A:
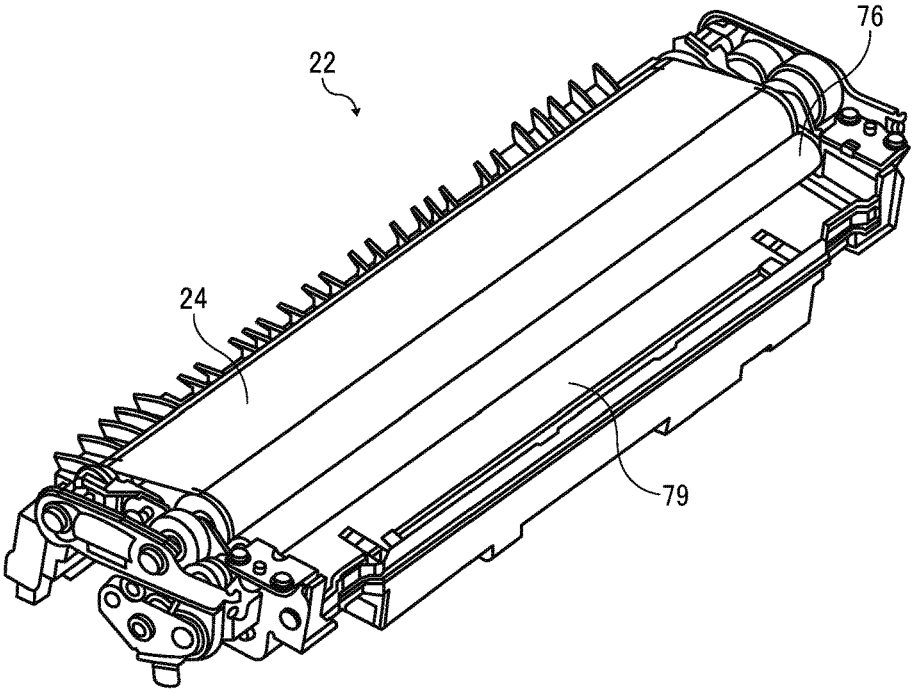
FIG. 4A is a simplified perspective view of the secondary transfer unit, omitting some parts illustrated in FIG. 2A.
Figure 4B:
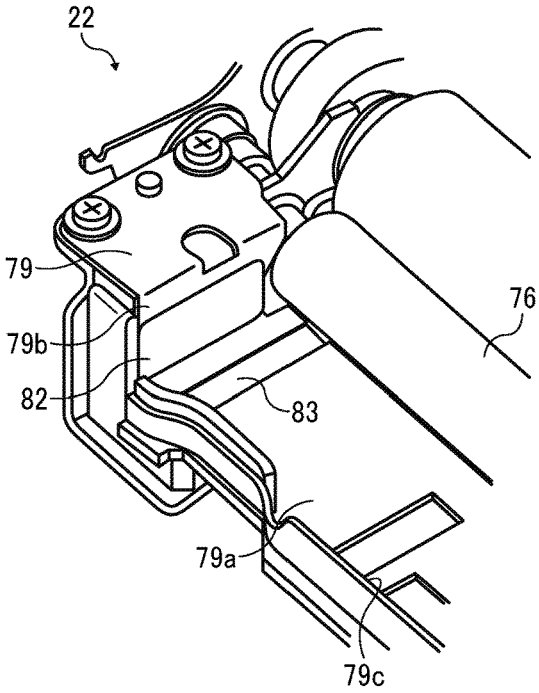
FIG. 4B is a partially enlarged view of the secondary transfer unit of FIG. 4A.

FIG. 4A is a perspective view of the secondary transfer unit 22 that is removed some parts, and FIG. 4B is a partially enlarged view of the secondary transfer unit 22 illustrated in FIG. 4A. FIG. 4A and FIG. 4B illustrate the secondary transfer unit 22 from which the conveyance guide 77 and the solid lubricant assembly 78 are removed. As illustrated in FIG. 4B, the retainer 79 includes a top face 79*a* extending in a longitudinal direction of the retainer 79, two side faces 79*b* positioned at both ends in the longitudinal direction of the retainer 79, and a back face 79*c* located on the opposite side of the lubricant application brush 76. In the retainer 79, the top face 79*a*, the two side faces 79*b*, and the back face 79*c* support the solid lubricant assembly 78 and identify its location.

The solid lubricant assembly 78 is set on the top face 79*a* of the retainer 79. The end portions 80 of the solid lubricant assembly 78, particularly, the bosses 80*a*, illustrated in FIG. 3B, contact the side faces 79*b*. This positions the solid lubricant assembly 78 in the longitudinal direction (X-direction). The pressure arm 88 of the solid lubricant assembly 78 contacts the back face 79*c* and pushes the solid lubricant assembly 78 toward the lubricant application brush 76. In this manner, the solid lubricant assembly 78 contacts the lubricant application brush 76.

Preferably, a side positioning portion 82 that is made of, for example, a stainless steel (SUS) sheet metal is disposed on the side face 79*b* of the retainer 79 so that the boss 80*a* of the solid lubricant assembly 78 and the side face 79*b* of the retainer 79 are more slippery. This prevents one-side contact of the end portions 80 caused by abrasion and improves reliability. The end portion 80 may directly contact the side positioning portion 82 without the boss 80*a* on the end portion 80. Alternatively, for example, a bottom positioning portion 83 including a slippery tape may be disposed on the top face 79*a* of the retainer 79.

Subsequently, the conveyance guide 77 is described. The conveyance guide 77 also positions the solid lubricant assembly 78 in the thickness direction (Z-direction).

Figure 5A:
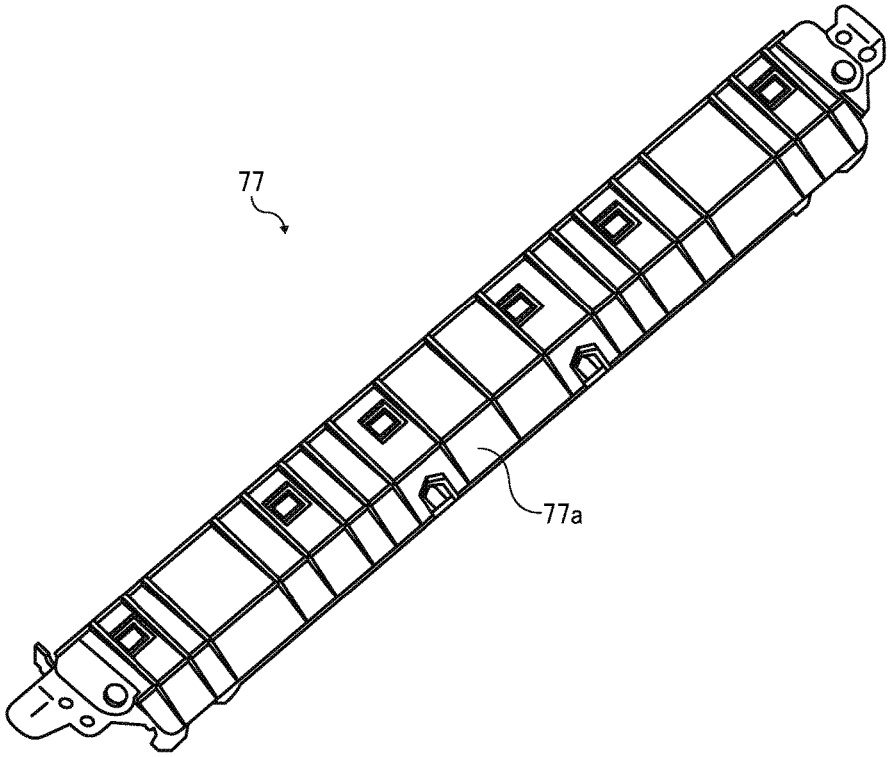
FIG. 5A is a perspective view of a conveyance guide.
Figure 5B:
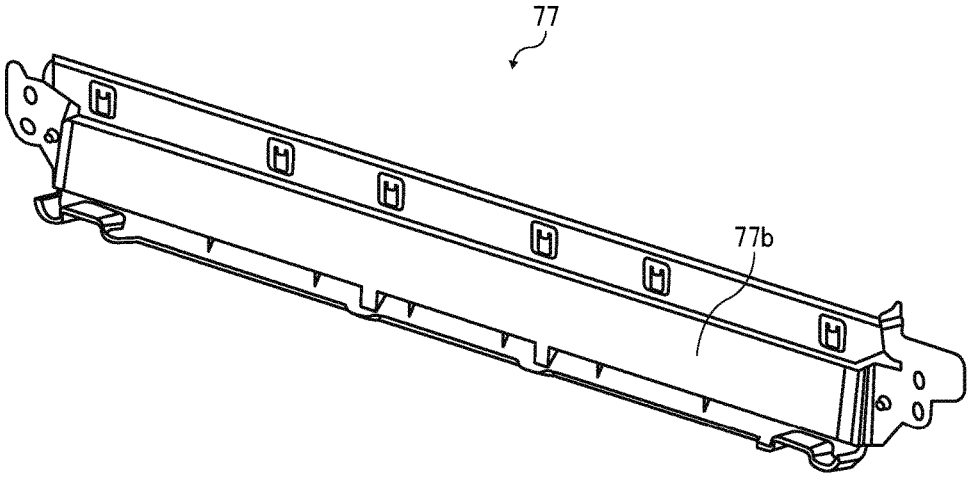
FIG. 5B is a perspective view of the rear face of the conveyance guide.

FIG. 5A is a perspective view of the conveyance guide 77. FIG. 5B is a perspective view of a rear face of the conveyance guide 77. As illustrated in FIGS. 5A and 5B, the conveyance guide 77 includes a guide portion 77*a* that contacts the recording medium and a base portion 77*b* that reinforces the guide portion 77*a*. The base portion 77*b* supports the guide portion 77*a*. The guide portion 77*a* is made of, for example, resin. The base portion 77*b* is made of, for example, a sheet metal. The guide portion 77*a* is attached to the base portion 77*b* by a snap-fit.

Figure 5C:
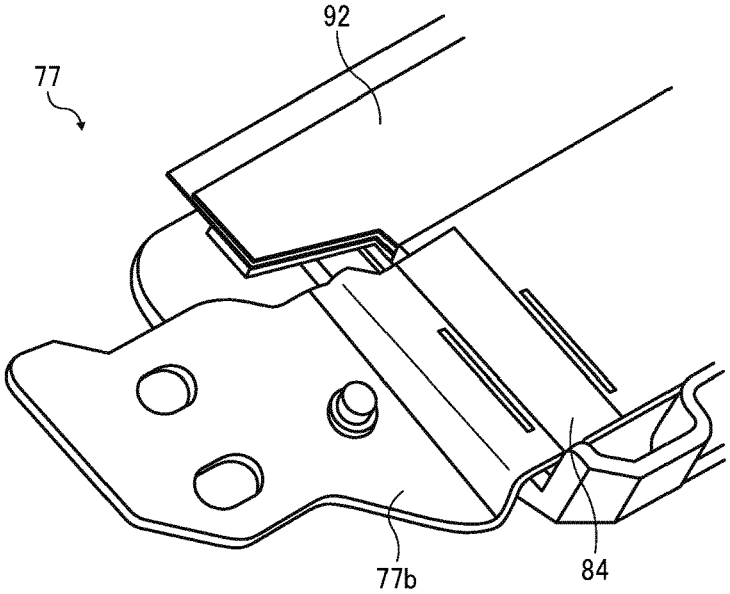
FIG. 5C is a partially enlarged view of the conveyance guide of FIG. 5B.

FIG. 5C is a partially enlarged view of the conveyance guide 77 illustrated in FIG. 5B. As illustrated in FIG. 5C, an exit seal 92 as a seal member is attached to the base portion 77*b* to prevent scattering of the lubricant. Additionally, a top positioning portion 84 formed by, for example, the slippery tape is disposed on the base portion 77*b*.

As illustrated in FIG. 2B, the conveyance guide 77 positions the solid lubricant assembly 78 in the thickness direction (Z-direction). Specifically, the top positioning portion 84 disposed on the base portion 77*b* of the conveyance guide 77 contacts the solid lubricant assembly 78, and positions the solid lubricant assembly 78. Such a configuration positions the solid lubricant assembly 78 without increasing a number of parts. Because this structure does not use a lubricant case or the like, the thickness Lh (see FIG. 3A) of the solid lubricant assembly 78 is increased, and the volume of the solid lubricant assembly 78 is certainly increased. Compared with the case of using a lubricant case or the like, this configuration can increase the volume of the lubricant. The top positioning portion 84 may be a protrusion instead of the slippery tape.

Subsequently, a description is given below of the secondary transfer unit 22 of the present embodiment in which how the position of the solid lubricant assembly 78 is identified when the lubricant application brush 76 is at rest and when the lubricant application brush 76 rotates to apply the lubricant.

Figure 6A:
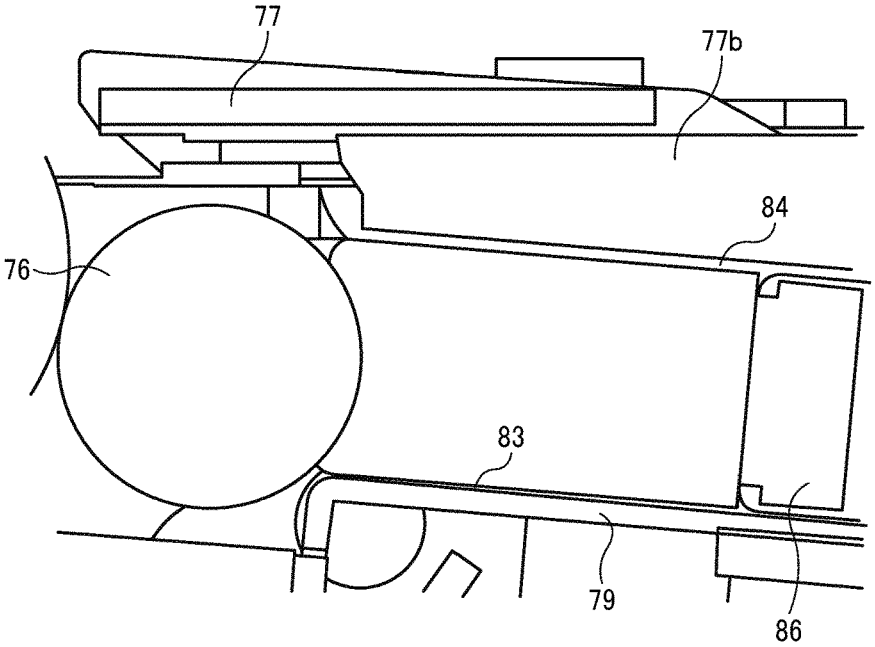
FIG. 6A is a schematic diagram illustrating positioning of the solid lubricant assembly in a thickness direction (Z-direction) and a height direction (Y-direction) in the secondary transfer unit.

FIG. 6A is a schematic diagram illustrating positioning the solid lubricant in a thickness direction (Z-direction) and a height direction (Y-direction) of the secondary transfer unit 22. As illustrated in FIG. 6A, the conveyance guide 77 (the top positioning portion 84) and the retainer 79 (the bottom positioning portion 83) identify the position in the thickness direction (Z-direction) of the solid lubricant assembly 78. With respect to the position in the height direction (Y-direction), the biasing portion 86 pushes the back face 79*c* of the retainer 79, the solid lubricant assembly 78 pushes the lubricant application brush 76, and the position of the solid lubricant assembly 78 in the height direction (Y-direction) is identified.

Figure 6B:
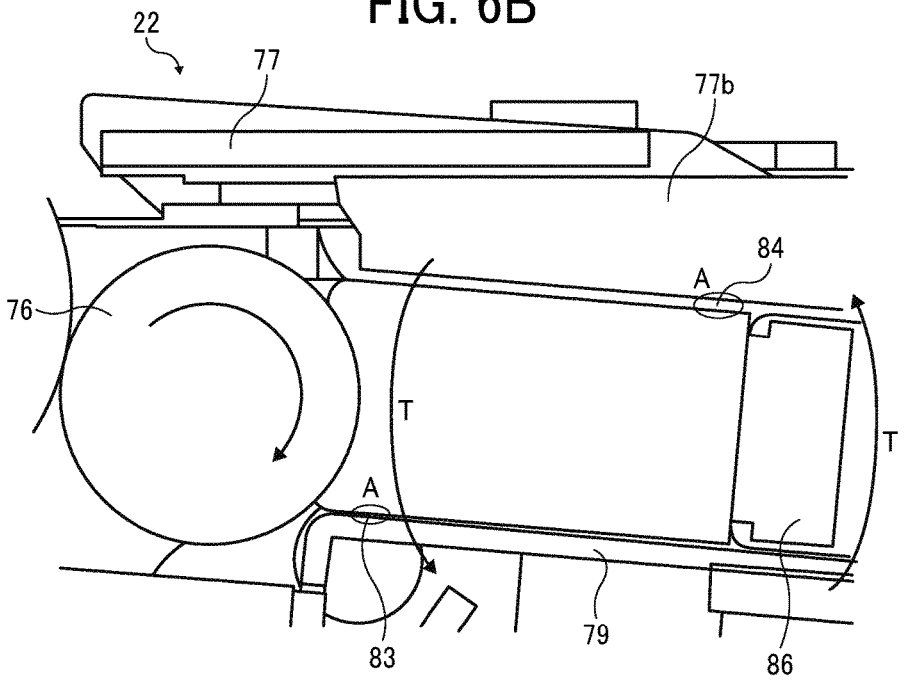
FIG. 6B is a schematic diagram illustrating positioning of the solid lubricant assembly during application of the solid lubricant in the secondary transfer unit.

FIG. 6B is a schematic diagram of the secondary transfer unit 22, illustrating positioning of the solid lubricant during application of the solid lubricant in the secondary transfer unit 22. As illustrated in FIG. 6B, as the lubricant application brush 76 rotates clockwise in FIG. 6B, the solid lubricant assembly 78 receives rotational torque T. In this case, the solid lubricant assembly 78 comes in line contact with the top positioning portion 84 of the conveyance guide 77 and the bottom positioning portion 83 of the retainer 79 at regions A in FIG. 6B, and the position of the solid lubricant assembly 78 in the thickness direction (Z-direction) is identified. Even when the volume of the lubricant portion 85 of the solid lubricant assembly 78 decreases, and the solid lubricant assembly 78 moves in the Y-direction, the position of the solid lubricant assembly 78 in the thickness direction (Z-direction) is identified. Therefore, the position of the solid lubricant assembly 78 is maintained for a long time, and the lubricant is applied without replenishing the lubricant by the field technician.

Subsequently, the advantages of the present disclosure are described.

Figure 7A:
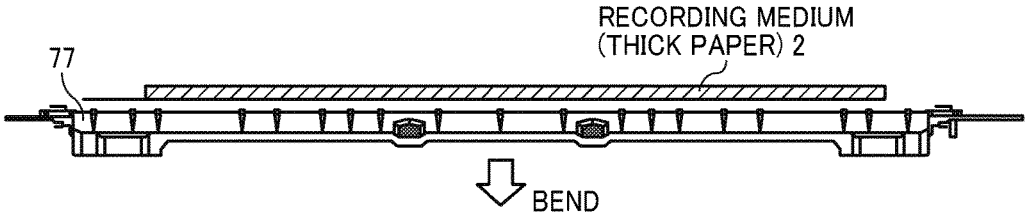
FIG. 7A is a schematic diagram of the conveyance guide as seen from a direction of conveyance of a recording medium.
Figure 7B:
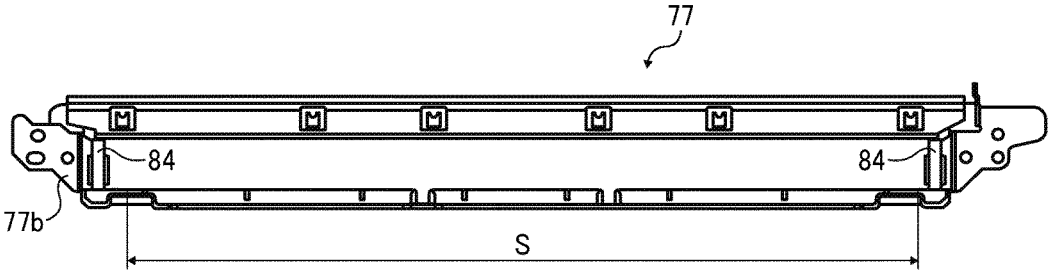
FIG. 7B is a schematic diagram illustrating a set position of a positioning portion of the conveyance guide.

FIG. 7A is a schematic diagram of a conveyance guide as seen from a direction of conveyance of a recording medium, and FIG. 7B is a schematic diagram illustrating the installation position of the positioning portion of the conveyance guide. In FIGS. 7A and 7B, the same reference numerals are given to the same components as those in FIGS. 5A, 5B, and 5C, and their detailed descriptions are omitted.

As illustrated in FIG. 7A, the central portion of the conveyance guide 77 may be bent when the conveyance guide 77 guides the recording medium 2. When the conveyance guide 77 is bent, the base portion 77*b* of the conveyance guide 77 may contact the solid lubricant assembly 78, and the position in the thickness direction (Z-direction) of the solid lubricant assembly 78 may be deviated. Therefore, preferably, the top positioning portion 84 disposed on the conveyance guide 77 forms a convex shape, and the conveyance guide 77 and the solid lubricant assembly 78 are separated by the thickness of the top positioning portion 84. The present embodiment uses the slippery tape as the top positioning portion 84, and the solid lubricant assembly 78 is separated from the base portion 77*b* of the conveyance guide 77 by the thickness of the tape. Since the base portion 77*b* of the conveying guide 77 is made of sheet metal, the thickness of the slippery tape is set to 0.2 mm. However, when the base portion 77*b* is not made of sheet metal, it is desirable to increase the thickness of the slippery tape further. That is, the thickness of the top positioning portion 84 is preferably larger than the maximum bend occurring when the conveyance guide 77 guides the recording medium 2.

Further, as illustrated in FIG. 7B, it is preferable that a pair of top positioning portions 84 provided in the conveyance guide 77 are located outside a conveyance area S of the recording medium 2 in the longitudinal direction. This is because the influence on the positional accuracy in the thickness direction (Z-direction) of the solid lubricant assembly 78 is reduced even if the conveyance guide 77 is bent.

Figure 8:
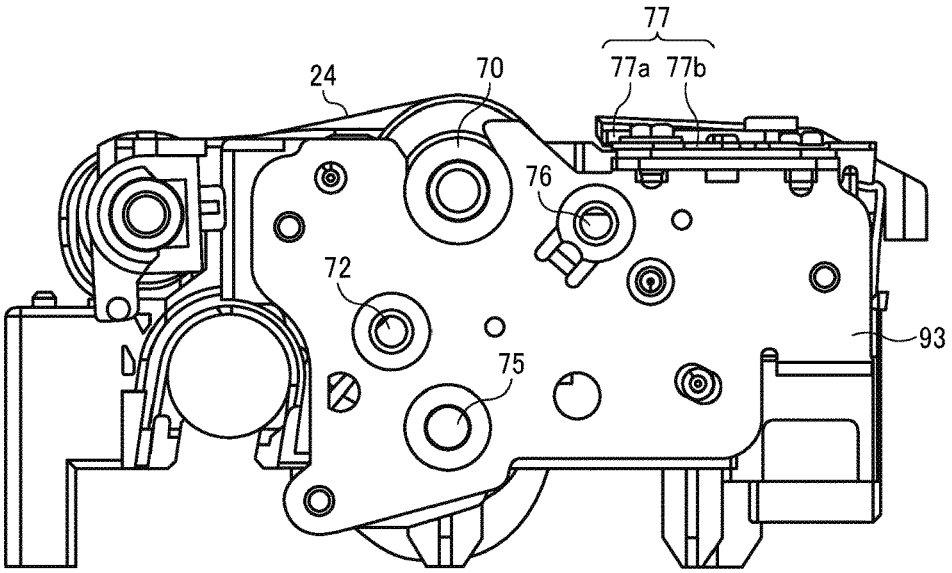
FIG. 8 is a side view of the secondary transfer unit in FIG. 2A.

FIG. 8 is a side view of the secondary transfer unit. For convenience of explanation, some parts such as gears are omitted. As illustrated in FIG. 8, preferably, a side plate 93 on the side surface of the secondary transfer unit 22 supports parts such as the secondary transfer roller 70, the lubricant application brush 76, the retainer 79, the conveyance guide 77, and the like. This configuration, in which the same side plate supports some parts, reduces a number of parts and improves the positional accuracy of parts such as the conveyance guide 77 in the secondary transfer belt 24.

Variation

Figure 9A:
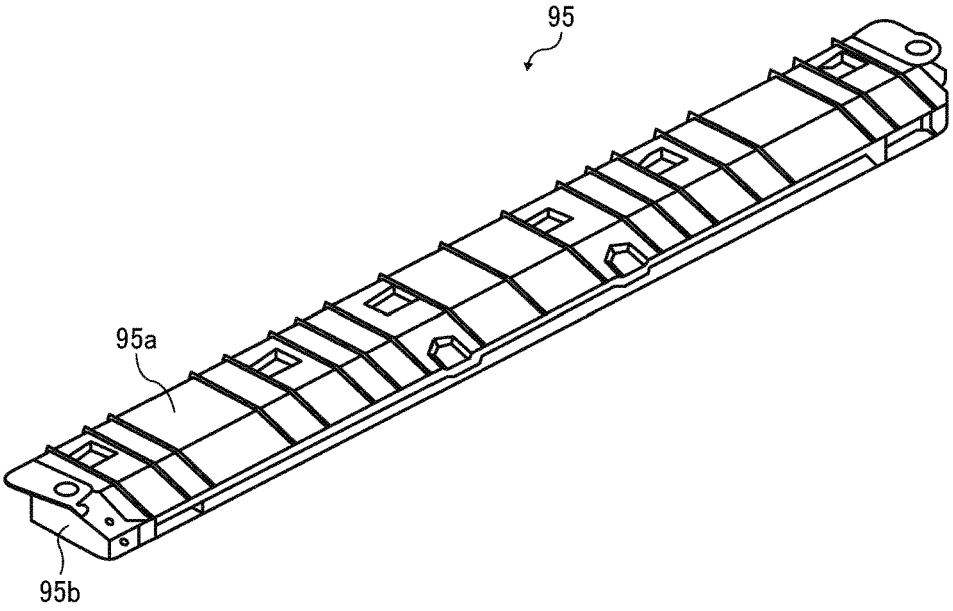
FIG. 9A is a perspective view of a variation of the conveyance guide.
Figure 9B:
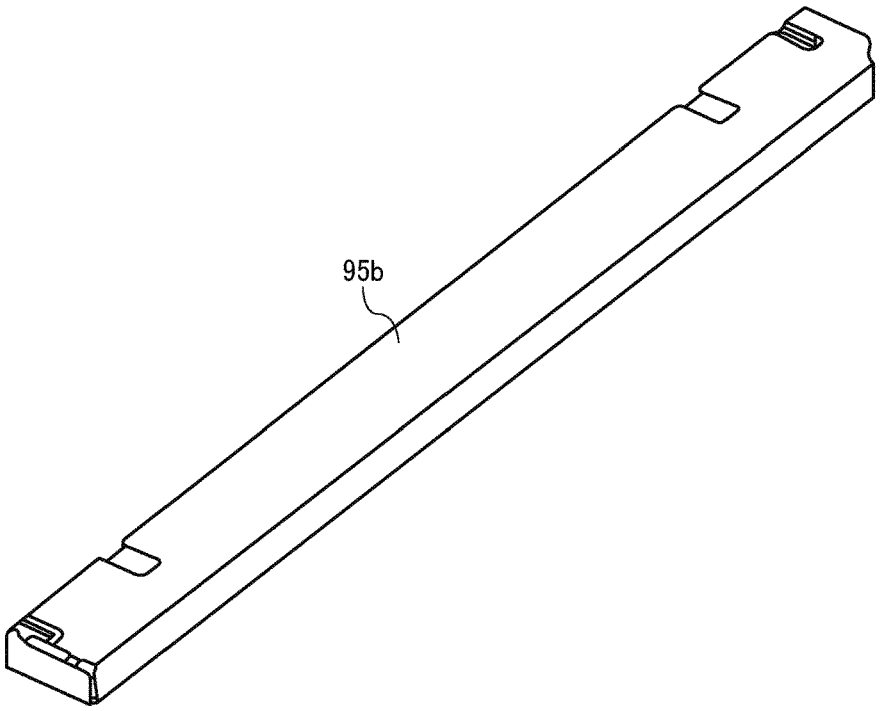
FIG. 9B is a perspective view illustrating a part of the conveyance guide in FIG. 9A.

FIG. 9A is a perspective view of a variation of the conveyance guide, and FIG. 9B is a perspective view illustrating a part of the conveyance guide in FIG. 9A. As illustrated in FIG. 9, the conveyance guide 95 of the present variation has a guide portion 95*a* and a case portion 95*b*. The case portion 95*b* has a structure in which the base portion 77*b* illustrated in FIG. 5B and the retainer 79 illustrated in FIG. 4A are integrated into a single unit.

The case portion 95*b* is a bottomed lubricant case having an opening only on one side. The case portion 95*b* also serves as a base member for reinforcing the guide portion 95*a* of the conveyance guide 95. Therefore, the guide member in the case is unnecessary, and the number of parts is reduced.

Figure 9C:
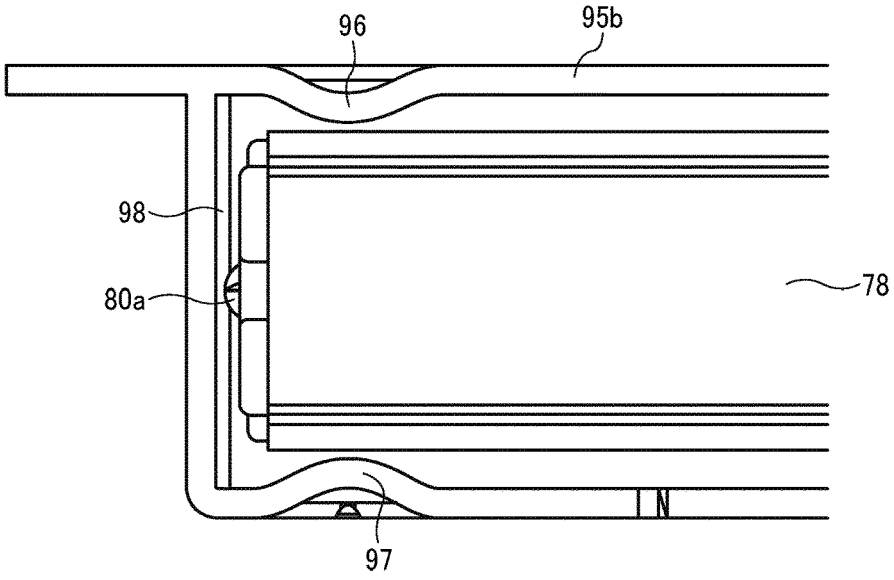
FIG. 9C is a partial enlarged view of a cross-section of the conveyance guide in FIG. 9A, as seen from the direction of conveyance of the recording medium.

FIG. 9C is a partial enlarged view of a cross-section of the conveyance guide in FIG. 9A, as seen from a direction of conveyance of the recording medium. As illustrated in FIG. 9C, sheet metal is drawn on the top face of the case portion 95*b* to form a convex top positioning portion 96. Similarly, on the bottom face of the case portion 95*b*, sheet metal is drawn in the same manner, and a convex bottom positioning portion 97 is formed. In this way, the solid lubricant assembly 78 may be positioned not by the slippery tape previously illustrated in FIG. 4B but by the positioning portions 96 and 97 in which the sheet metal is drawn. Further, on the side face of the case portion 95*b*, for example, a side positioning portion 98 which is a sheet metal made of stainless steel (SUS) may be disposed. The side positioning portion 98 positions of the solid lubricant assembly 78 in the longitudinal direction. The side positioning portion 98 may be made to be slippery with the boss 80*a* of the solid lubricant assembly 78.

The present disclosure is described above based on the embodiments. The present disclosure is not limited to the embodiments described above and various modifications and improvements are possible. According to the embodiments described above, the solid lubricant assembly 78 applies the lubricant to the secondary transfer belt 24. Alternatively, the solid lubricant assembly 78 may apply the lubricant to the intermediate transfer belt 10. For example, although the transfer device of the present embodiments employs the intermediate transfer system, the present disclosure may be applied to a direct transfer system. The present disclosure may also be applied to a system in which a roller-shaped secondary transfer roller is used as the rotating body instead of the secondary transfer belt 24. According to the embodiments described above, the solid lubricant assembly 78 applies the lubricant to the secondary transfer belt 24. Alternatively, the solid lubricant assembly 78 may apply the lubricant to the secondary transfer roller 70. In this case, the secondary transfer belt 24 is not looped over the secondary transfer roller 70 and the secondary transfer roller 70 contacts the intermediate transfer belt 10. That is, the present disclosure may be applied to a transfer device including a rotating body that rotates in contact with a recording medium at a transfer position at which an image is transferred.

Further, in the present embodiments, the lubricant is applied from the solid lubricant assembly 78 to the secondary transfer belt 24 by the lubricant application brush 76, but the disclosure is not limited thereto. The solid lubricant assembly 78 may directly contact the rotating body (the secondary transfer belt 24) and apply the lubricant.

Further, in the above-described embodiment and variation, the transfer device includes an intermediate transfer belt 10 as an image bearer, a secondary transfer belt 24 to form a transfer nip for transferring the image on the intermediate transfer belt 10 to the sheet 2 with the intermediate transfer belt 10 and rotate while contacting the sheet 2, a solid lubricant assembly 78 extending in the longitudinal direction of the secondary transfer belt 24 to apply a lubricant to the secondary transfer belt 24, and a conveyance guide 77 disposed on the upstream side of the transfer nip in the sheet direction of conveyance to guide the sheet 2 conveyed toward the transfer nip, and position the solid lubricant assembly 78. However, the present disclosed aspect is not limited above.

The present disclosure may be applied to a transfer device that includes an intermediate transfer belt 10 as an image bearer, a secondary transfer belt 24 to form a transfer nip for transferring the image on the intermediate transfer belt 10 to the sheet 2 with the intermediate transfer belt 10 and rotate while contacting the sheet 2, a solid lubricant assembly 78 extending in the longitudinal direction of the secondary transfer belt 24 to apply a lubricant to the secondary transfer belt 24, and a conveyance guide 77 disposed on the downstream side of the transfer nip in the sheet direction of conveyance to guide the sheet 2 conveyed from the transfer nip, and position the solid lubricant assembly 78.

Furthermore, the image forming apparatus including the transfer device of the present disclosure is not limited to a copy machine or a printer, but may be a facsimile machine or a multifunction peripheral having a plurality of these functions.

What is claimed is:

1. A transfer device comprising:

an image bearer to bear an image;

a rotatable body that forms a transfer nip with the image bearer to rotate in contact with a recording medium, the transfer nip where the image on the image bearer is transferred onto the recording medium;

a solid lubricant assembly including a solid lubricant and extending in a longitudinal direction of the rotatable body, the solid lubricant assembly to apply the solid lubricant to at least one of the rotatable body and the image bearer; and a guide to guide the recording medium and position the solid lubricant assembly.

2. The transfer device according to claim 1, wherein the guide includes a positioning portion to position the solid lubricant assembly in a thickness direction orthogonal to a longitudinal direction of the solid lubricant assembly.

3. The transfer device according to claim 2, wherein the positioning portion of the guide is disposed outside a conveyance area of the recording medium in the longitudinal direction of the solid lubricant assembly.

4. The transfer device according to claim 2, wherein the positioning portion has a convex shape, and a thickness of the positioning portion is larger than a maximum bend occurring when the guide guides the recording medium being conveyed.

5. The transfer device according to claim 1, wherein the guide includes a guide portion to guide the recording medium and a base portion to reinforce the guide portion.

6. The transfer device according to claim 1, further comprising a retainer that holds and positions both ends of the solid lubricant assembly in a longitudinal direction of the solid lubricant assembly and one face of the solid lubricant assembly in a thickness direction of the solid lubricant assembly, and wherein the guide positions another face of the solid lubricant assembly in the thickness direction of the solid lubricant assembly.

7. The transfer device according to claim 1, further comprising a retainer that holds and positions both ends of the solid lubricant assembly in a longitudinal direction of the solid lubricant assembly and one face of the solid lubricant assembly in a thickness direction of the solid lubricant assembly, wherein the guide includes:

a guide portion to guide the recording medium; and a base portion to reinforce the guide portion, and positions another face of the solid lubricant assembly in the thickness direction of the solid lubricant assembly, and wherein the base portion and the retainer form a single integrated unit.

8. The transfer device according to claim 1, further comprising a cleaning blade to remove toner adhering to a surface of the rotatable body after the image is transferred from the surface of the rotatable body, wherein the solid lubricant assembly is disposed between the cleaning blade and the guide.

9. The transfer device according to claim 1, further comprising a biasing portion to press the solid lubricant against the rotatable body.

10. The transfer device according to claim 1, further comprising a lubricant applicator to apply the solid lubricant to the rotatable body.

11. The transfer device according to claim 1, further comprising:

a secondary transfer roller to support the rotatable body; and at least one side plate to support the secondary transfer roller and the guide, wherein the rotatable body includes a transfer belt supported by the secondary transfer roller.

12. The transfer device according to claim 1, wherein the rotatable body includes a transfer roller.

13. The transfer device according to claim 1, wherein the image bearer includes an intermediate transfer belt.

14. An image forming apparatus comprising the transfer device according to claim 1.

* * * * *